US006656570B1

(12) United States Patent
Fels et al.

(10) Patent No.: US 6,656,570 B1
(45) Date of Patent: Dec. 2, 2003

(54) PUNCTURE-AND BULLET PROOF PROTECTIVE CLOTHING

(75) Inventors: Achim Fels, Wuppertal (DE); Christian Bottger, Remscheid (DE); Wolfgang Polligkeit, Herborn (DE); Steffen Neu, Dillenburg (DE); Christoph Klingspor, Hickory, NC (US)

(73) Assignee: Teijin Twaron GmbH, Wuppertal (DE)

( * ) Notice: Subject to any disclaimer, the term of this patent is extended or adjusted under 35 U.S.C. 154(b) by 0 days.

(21) Appl. No.: 09/600,820

(22) PCT Filed: Jan. 18, 1999

(86) PCT No.: PCT/EP99/00258

§ 371 (c)(1),
(2), (4) Date: Aug. 8, 2000

(87) PCT Pub. No.: WO99/37969

PCT Pub. Date: Jul. 29, 1999

(30) Foreign Application Priority Data

Jan. 22, 1998 (DE) ..... 198 02 242

(51) Int. Cl.[7] ..... B32B 27/12

(52) U.S. Cl. ..... 428/155; 428/911; 442/134; 442/135; 442/164; 442/169; 2/2.5

(58) Field of Search ..... 428/911, 155; 442/134, 135, 164, 169; 2/2.5

(56) References Cited

U.S. PATENT DOCUMENTS 2,058,120 A * 10/1936 Wirbelauer ..... 428/155
3,707,004 A * 12/1972 Kapitan et al. ..... 128/201.23
4,550,044 A * 10/1985 Rosenberg et al. ..... 156/290
5,677,029 A * 10/1997 Prevorsek et al. ..... 428/105

FOREIGN PATENT DOCUMENTS

| | | | | |
|---|---|---|---|---|
| DE | 44 13969 A1 | | 10/1995 | |
| EP | 0 640 807 A1 | | 3/1995 | |
| GB | 2 090 725 A | | 7/1982 | |
| GB | 2 235 929 A | | 3/1991 | |
| HU | 212 859 B | | 11/1991 | |
| HU | 218 650 B | | 9/1996 | |
| IL | 499812 | | 1/1939 | |
| JP | 62062198 | * | 3/1987 | ..... B32B/5/26 |
| WO | WO 96/03277 | | 2/1996 | |
| WO | WO 97/21334 | | 6/1997 | |

* cited by examiner

*Primary Examiner*—Ula C. Ruddock
(74) *Attorney, Agent, or Firm*—Oliff & Berridge, PLC

(57) ABSTRACT

Protective clothing for protection against puncture injuries is constructed from more than one layer of a fabric coated with hard solids. The hard solids are applied in accordance with abrasives technology. This protective clothing offers equally good protection against both knife- and needle-like puncture implements. For clothing intended to protect against puncture and projectile injuries, a package of 2–20 layers of a fabric coated with hard solids is combined with a package of 6–50 layers of an uncoated aramid woven fabric.

14 Claims, No Drawings

PUNCTURE-AND BULLET PROOF PROTECTIVE CLOTHING

BACKGROUND OF THE INVENTION

1. Field of Invention

The invention relates to protective clothing, in particular clothing for protecting against puncture or projectile injuries, consisting of a plurality of fabric layers made from high-strength materials.

In the line of duty, police and other security forces are subject not only to the danger of projectile injuries but also increasingly to attacks with knives, daggers, and other puncture implements, which often have needle-like character. The resulting safety requirements for police forces cannot be adequately satisfied by conventional bulletproof vests, which often are part of the standard equipment of this group of individuals, since these vests do not provide sufficient protection against puncture injuries.

2. Description of Related Art

For this reason, special protective clothing has been developed that is primarily intended to offer protection against puncture injuries. There have also been attempts to produce clothing that protects against both projectile and puncture injuries, however. While many of the proposals meet the requirements of police forces, they are poorly suited for use when a high degree of physical mobility is required, due to their heavy weight and frequent lack of flexibility.

Moreover, police forces demand that protective clothing protect not only against injuries by knives, daggers, and similar puncture implements, but also against needle-like puncture implements, which are in part also employed in attacks on police.

Although various problem solutions, primarily involving the use of aramid woven fabrics either wholly or in part, have been suggested for manufacturing puncture-proof clothing, none has been completely satisfactory.

For example, GB-A 2 283 902 describes puncture-proof clothing constructed from aramid woven fabrics, with metal plates affixed to the surface. Such clothing has a low degree of wearing comfort, since it does not ensure the needed flexibility and also forces the wearer to accept the heavy weight. Protective clothing in a similar embodiment is described in WO-A 91-06 821.

In DE-C 4 407 180, the use of a metal insert embedded in a polyurethane matrix is proposed for puncture-proof clothing. This metal insert takes the form of a network-like structure of steel chains. The disadvantage of this type of puncture-proof clothing is that it offers good protection only from blade-type puncture implements such as knives, daggers, etc., but not from sharply pointed, needle-like implements.

U.S. Pat. No. 4,933,231 describes a dense foamed-plastic-encased woven fabric made from high-strength aliphatic polyamide fibers, the fabric appearing to be suitable especially for clothing protecting against incisions. This embodiment cannot provide the puncture protection demanded by security forces.

This is also true for the puncture-proof clothing proposed by EP-A 224 425, which is produced from knitted fabrics made from aramid fibers. In this case as well, there are insufficient puncture protection characteristics. The proposed knitted fabric is more suited to incision protection.

Particularly breathable puncture-proof clothing, intended to be produced by employing a so-called climatic membrane made from dense woven fabric, is described in U.S. Pat. No. 5,308,689. The embodiment proposed in this case does not offer sufficient puncture-proof characteristics.

Puncture-proof clothing made from overlapping glass-fiber-reinforced plastic plates arranged on a textile base is described in WO 92-08 094. Due to its lack of flexibility, such protective clothing does not offer the desired wearing comfort.

Furthermore, several proposals have been made for protective clothing for combined puncture and bullet protection, in various embodiments.

For example, U.S. Pat. No. 5,562,264 proposes the use of extremely dense woven fabrics made from relatively fine yarns. These are intended to provide protection in a similar manner against puncture and projectile injuries. This problem solution is not satisfactory, since the production of the fabrics is very expensive and the weaving at a high density can cause fiber damage, leading primarily to reduced retention characteristics for projectiles. Moreover, the puncture protection in this embodiment does not adequately meet the specifications of all countries.

In DE-A 4 413 969, puncture-proof clothing made from multiple layers of metal foils is proposed. By combination with laminates made from aramid-fiber woven fabrics, protection against bullets is also attained. In addition to the high cost of metal foils, this protective clothing also does not provide satisfactory wearing comfort due its low degree of flexibility. Moreover, the rustling caused by the metal foils is regarded as disagreeable when the clothing is worn. A similar embodiment of puncture-proof clothing is found in EP-A 640 807, which proposes fabrics made from narrow metal foil strips.

A package of woven fabrics, such as those made from aramid fibers, formed into a plate using a thermoplastic matrix resin, is described in EP-A 597 165. This relatively rigid structure does not offer the desired wearing comfort.

In WO 97-21 334, aramid fabrics coated with thermoplastic resins are proposed for combined puncture and bulletproof protective clothing. This embodiment does not allow puncture-proof clothing that meets the requirements of security forces in all countries in the acceptable weight ranges.

According to DE-A 4 214 543, clothing intended to provide combined protection against punctures and projectiles and also against impact is manufactured in the puncture-proofing layers from metal plates displaceable with respect to one another and forming the outer layer of the protective clothing. Underneath is a fabric package intended for bulletproofing. This protective clothing as well shows the usual disadvantages of metal plates: a low degree of flexibility and relatively heavy weight, thus adversely affecting wearing comfort.

In DE-U 94 08 834, a package of superimposed layers with alternating textile fabrics made from aramid fibers and metal netting is proposed for combined puncture and bullet protection. The disadvantage of this embodiment is the low degree of protection from needle-like implements.

WO 96-03 277 describes protective clothing containing at least one layer of a fabric to which a ceramic layer has been applied by plasma spray coating. While this type of protective clothing attains good protection against puncture and projectile injuries, the manufacture is complicated, due to the plasma spray coating process employed, and also uneconomical from a cost standpoint. Moreover, application of the ceramic layer can lead to a partial fusion of the ceramic particles by sintering, due to the high temperatures in the plasma, so that the protective action against puncture implements can suffer somewhat. Furthermore, there are also some problems with respect to abrasion resistance.

The use of abrasive materials has been proposed for protective clothing. According to GB-A 2 090 725, for example, the protective action against projectiles is intended to be increased if the outer layer of an antiballistic package contains abrasive material such as aluminum oxide, boron carbide, etc. Tests have shown that a layer of such a material does not have a positive effect on the protective action against projectiles. To what extent the puncture-proof characteristics can be improved using the proposed embodiment cannot be determined from the document. Moreover, it contains no information whatsoever concerning the amount of abrasive material or the process for manufacturing such a protective layer.

According to a proposal in U.S. Pat. No. 5,087,499, a very thin layer of abrasive material is applied to aramid yarns that are subsequently to be subjected to fibrillation. This is intended primarily to provide protection from puncture injuries by surgical instruments. The very thin layer disclosed in this document can provide no protection at all against injuries inflicted by knives.

Even using prior art abrasive materials, the described embodiments do not allow manufacture of protective clothing for security forces that offers adequate protection against puncture injuries as well as those from projectiles.

SUMMARY OF THE INVENTION

For this reason, the object arose to develop puncture-proof clothing that not only offers the same protection for puncture injuries inflicted by knives, daggers, etc. as provided by the known puncture-proof clothing, but that moreover ensures protection against needle-like implements. Furthermore, the object arose to improve wearing comfort compared to the prior art puncture-proof clothing, while ensuring good protective action.

A further object was to design the materials for puncture protection such that they are also usable for combined puncture- and bulletproof clothing.

Surprisingly, it was discovered that this object can be satisfied in a particularly advantageous manner if the protective clothing comprising multiple layers has more than one layer coated with a hard-solid layer, whereby the hard solids are embedded in phenolic resins, urea resins, latex in cross-linked or non-cross-linked form, epoxy resins, or polyacrylate resins.

DETAILED DESCRIPTION OF PREFERRED EMBODIMENTS

Clothing to protect against injuries from punctures and projectiles is normally constructed from multiple layers. Existing clothing has varying numbers of layers. The selection of the number of layers depends on various factors such as the protective action required, the desired wearing comfort, clothing costs, etc. In general, the number of layers must be as low as possible but high enough to satisfy the protection requirements.

WO 98/45 662, not previously published, discloses a puncture-proof material consisting of a base coated with solid particles, which is arranged on a package of fabric structures. The coating consists of abrasive particles with a diameter of 0.1 to 3 mm, and the package of fabric structures is thicker than 1.5 mm. Also in accordance with WO 98/45 662, multiple coated bases can be employed. The solid particles, however are applied to the base with a bituminous adhesive or one containing polyurethane.

The protective layers of the puncture- and bulletproof clothing are normally constructed from fabrics made from high-strength materials. These fabrics are preferably textile fabrics, whereby woven fabrics are especially preferred. In addition to woven fabrics, however, other textile fabrics such as knits, nonwoven fabrics, thread composites, etc. can be employed.

Non-textile fabrics include in particular sheeting, foils, or thin foamed-plastic layers.

High-strength materials are those exhibiting a high degree of strength and good protection against the effects of projectiles and puncture implements. They are primarily polymers processed into fibers.

Preferred materials used for the manufacture of the protective layers of the protective clothing of the invention are aramid fibers, polyethylene fibers spun using the gelspinning process, polyimide fibers, polybenzoxazol fibers, fully aromatic polyester fibers, high-strength polyamide fibers, high-strength polyester fibers, and fibers with similar properties. Aramid fibers are particularly preferred.

Aramid fibers, often also referred to as aromatic polyamide fibers, are frequently used in protective clothing. They are fiber materials made from polyamides that are substantially generated by polycondensation of aromatic acids or their chlorides with aromatic amines. Especially well known are aramid fibers consisting of poly-p-phenylene terephthalamide. Such fibers are commercially available under the trade name Twaron, for example.

Aramid fibers, however, are not limited to fibers constructed solely from aromatic acid or amine components. Rather, they also include fiber materials whose polymer has a fraction of aromatic acids and aromatic amines exceeding 50% and that in addition contain aliphatic, alicyclic, or heterocyclic compounds in the acid and/or amine fraction.

For the woven fabrics to be employed preferably for producing the protective layers of the protective clothing of the invention, the preferred aramid fibers can be present in the form of filament yarns or spun-fiber yarns. Filament yarns are preferred. Spun-fiber yarns also include yarns produced by the tow-to-top breaking process.

The titers of the yarns to be used are between 200 and 3 400 dtex, preferably between 400 and 1 500 dtex. The filament titers are generally under 5 dtex, preferably under 1.5 dtex.

The woven fabrics are preferably produced in linen weave. Other weaves such as hopsack or twill can also be selected for fabric production, however.

The thread count depends on the yarn titer used and the desired weight per unit area of the fabrics to be used for the protective layers. The weight per unit area of these fabrics should be between 50 and 500 g/m$^2$, preferably between 100 and 300 g/m$^2$.

An example of a fabric advantageously used for the protective clothing of the invention is produced in linen weave from a yarn with a titer of 930 dtex. The thread counts in this case are 10.5/cm in warp and weft. With such a weave density, a fabric with a weight per unit area of approx. 200 g/m$^2$ is obtained. The data given here should be understood as exemplary and not restrictive.

Synthetic fibers generally contain a lubricant remaining from the fiber production process, which, among other things, has a positive influence on the rolling qualities of the yarn during fabric manufacture. Prior to conducting subsequent processes, such as the coating in preparation for applying a hard-solid layer, the fabric coming from the power loom, i.e., in the loom state, is subjected to a washing treatment. This treatment is normally performed on a full-width washing machine, although other full-width washing apparatus known in the textile finishing industry can also be used. The washing conditions such as temperature, treatment time, and additives to the washing bath are known to one skilled in the art. The washing conditions are selected so that the residual lubricant content following this treatment is less than 0.1%. Finally, drying of the fabric takes place, normally on a tenter frame.

Fabrics intended to form the actual bulletproof layers in the protective clothing of the invention, and which are not provided with a hard-solid coating, can be used in this form. In many cases, the washing treatment is followed by a hydrophobizing treatment, for example using a polymeric or polymerizable fluorocarbon compound.

Washed fabrics are preferred for the hard-solid coating, but it is also possible to use fabrics in the loom state, i.e., unwashed. In a preparatory step for the hard-solid coating, a precoating is applied to the fabric. This is necessary to prevent penetration of the subsequently applied binder layer, needed to incorporate the hard solids, into the base fabric.

A large number of different products can be used for the precoating. Examples are phenolic resins, urea resins, latex in cross-linked or non-cross-linked form, epoxy resins, or polyacrylate resins. In addition to the dispersed resin or the precursors for the resin, the compound for the precoating also contains fillers in a ratio of 30%–70%. An example of a filler is calcium carbonate.

The precoating is applied with a coverage of 40–100 $g/m^2$. After evaporation of the liquid present in the coating compound, about 30–75 $g/m^2$ remains on the fabric.

Normally, application of the precoating is followed by an intermediate drying stage, for example at a temperature of 100° C. It is also possible, however, to work wet-on-wet, i.e., to apply the subsequent main coating without intermediate drying.

For the main coating, the classes of compounds previously discussed for the precoating are suitable. Phenolic resins find preferred use for the main coating. However, the products for the pre- and main coatings are subject to differing requirements depending on the differences in the desired objectives. The product for the precoating must form a well-closed, preferably elastic film, to prevent subsequent penetration of the main coating into the base material. On the other hand, the essential characteristic of the product forming the main coating is the optimum incorporation of the hard solids.

In the main coating as well, there is a filler fraction, which can amount to 20–50% of the total amount of binder. The quantity of main coating to be applied is between 90 and 150 $g/m^2$ in the wet state. After drying, the amount of main-coating binder is 60–120 $g/m^2$.

Hard solids are understood to be inorganic substances with a high grade of hardness, such as are also used in the abrasive layer of abrasives, for example. Examples are silicon carbide, corundum (aluminum oxide), tungsten carbide, titanium carbide, molybdenum carbide, zirconium corundum (fused corundum with 40% zirconium oxide), boron carbide, or boron nitride. This list of hard solids is not intended to be exhaustive; it serves only to provide examples and should not be considered restrictive. Preferably, silicon carbide and/or corundum are used to form the hard-solid layer.

The cited substances are preferably used alone, but mixtures of different hard solids can also be employed.

The hard solids can be used in various forms. Preferred are so-called block and pointed forms. The former are preferably round particles. These have the advantage that they permit a high bulk density. The shape of the hard-solid particles, however, is significant only in the case of larger particle diameters. For smaller diameters, the differences in the particle shape are barely noticeable.

The application of the hard solids is performed on a substrate provided with a binder layer using a method commonly employed when applying abrasives.

In these methods, there is preferably a spreading of the hard solids or their application in an electrostatic field. In the first method, normally referred to as gravity spreading, the hard solids fall from the slit of a spreading funnel onto the course of fabric to which the precoating and main coating have been applied. The spreading density is controlled on the one hand by the width of the slit and on the other hand by the speed at which the fabric is moving.

In the electrostatic method, the application is performed using an electrostatic field. The hard-solid particles orient themselves in this field along the lines of flux of the electrostatic field and migrate along these lines to the opposite pole. The mobility of the hard-solid particles in the electrostatic field is utilized in abrasives technology in that the base layer to which the precoating and main coating has been applied is moved along the upper electrode through the electrostatic field. The coated side of the base is positioned toward the opposite electrode. The hard-solid particles, which are located at the lower electrode, migrate in the electrostatic field upward toward the opposite electrode and are anchored in the binder film of the base.

The introduction of the hard-solid particles into the electrostatic field is performed using a continuous conveyor belt that moves along the lower electrode and onto which the hard-solid particles are applied outside the electrostatic field using a spreading funnel.

The electrodes are preferably plate electrodes, but linear or pointed electrodes can also be used.

A further possibility to apply the hard-solid layer is by forming a paste, which is also known in abrasives manufacturing. Here, the hard solids are stirred into the binder compound, which is then poured or brushed onto the base.

The fabrics for the protective clothing of the invention, coated with hard solids, are preferably produced by gravity spreading, since this method enables a high density of the hard-solid particles to be achieved.

After applying the hard solids, a hardening of the binder film takes place at a temperature of approx. 130° C. Through the evaporation of liquid, the thickness of the binder film decreases somewhat, so that the hard-solid particles appear to an increased extent on the surface of the coated side. This decrease in thickness of the binder film is also utilized with the paste process, since the evaporation of liquid and reduction of the film thickness enable the hard solids stirred into the binder compound to migrate to the surface after drying.

In addition to the hot-air drying normally conducted in abrasives manufacture, it is also possible to employ other processes for hardening the binder film, such as the use of electron beams, microwaves, UV rays, etc.

When producing the fabric of the invention, which is coated with hard solids, it is possible to also perform a surface sealing of the hard-solid layer. In this case, a thin layer of an elastomeric polymer is applied to the hard-solid layer, for example by spraying it with a dispersion of an elastomer. Another possibility is to use a roller application. Here, a roller moves through a reservoir trough containing the dispersion to be applied. After leaving the trough, the excess dispersion taken up is scraped off, for example with a doctor blade, so that a thin film is produced on the applying roller for transfer to the hard-solid layer.

Hardening of the sealing layer is done in a manner similar to that for the binder layer, preferably by a drying treatment.

In a final work step, a flexing process is conducted. Flexing is a defined break-up of the rigid covering layer using mechanical means, resulting in the creation of small islands of binder layer, including the hard solids anchored in this layer, on the base material. The flexibility, resulting from flexing, of the base coated with hard solids is probably attributable to the fine crack structures formed thereby in the adhesive film. The conditions for flexing and the machinery it requires are well known in the adhesives industry.

Preferably, production of the fabric coated with hard solids is performed using cross-flexing, i.e., a flex treatment is performed in the transverse as well as longitudinal direction of the fabric.

The flexing produces a good elasticity of the fabric coated with hard solids for use in the protective clothing of the invention, manifesting itself quite favorably in the wearing comfort of this clothing.

The fabrics coated with hard solids and produced in the described manner exhibit a thickness between 0.1 and 1.5 mm, preferably between 0.2 and 0.8 mm, depending on the diameters of the hard solids used.

Determination of the thickness of the hard-solid layer is performed using the known method in the textile industry for measuring woven fabrics. Here, the thickness of the uncoated fabric is first determined and then that of the fabric coated with hard solids. The measurement is performed according to DIN 53 353. The difference in thickness yields the thickness of the hard-solid layer.

The fabrics coated with hard solids and produced in the described manner can be used for clothing providing protection against puncture injuries or combined protection against puncture and projectile injuries. Preferably, fabrics are used that are coated on only one side with hard solids. It is possible to use fabrics coated on both sides, however.

Clothing intended to protect only against puncture injuries is produced from more than one layer of the fabric coated with hard solids, preferably 2–20 layers, with 6–15 layers being especially preferred. In this case, the layers are superimposed and cut to shape as required for the clothing. The mutual reinforcement of the individual layers is performed, for example, by two cross-forming seams of approx. 10 cm each in the center of the cut piece. Another possibility of reinforcing the layers is pointwise application of adhesive.

The essential element is that there is no rigid joining of the individual layers with respect to each other and that the individual layers remain mobile.

It has been shown, however, that it is also possible to introduce the layers into the protective clothing without mutual reinforcement, since with the fabrics coated with hard solids there is much less shifting of the layers than if the fabrics are uncoated. Presumably, the hard-solid layer, especially in adjacent layers coated with hard solids but also in those that are uncoated, effects an anchoring with a type of Velcro(R) effect, so that slippage can largely be avoided. This is especially true if textile fabrics such as wovens or knits are used as the base material for the coating with hard solids. In the case of woven fabrics and knits, interstices are present that are not covered by the yarns. The hard solids of the adjacent layer can penetrate these interstices and become anchored therein. In the case of sheeting with a substantially well-closed surface, this is not possible, or possible only to a limited extent.

The hard-solid coated fabrics, combined into a package with 2–20 layers and cut to shape for the clothing required, are placed into an envelope made from PVC or thermoplastic polyurethane sheeting and sealed therein. Instead of sheeting, a woven fabric coated with a fusible polyurethane layer and made from polyamide fibers, for example, can also be used. In this case, the coated side is the inside.

The package thus formed is then placed into a cover of cotton woven fabric or a woven fabric of polyester-cotton blended yarns. Blended yarns made from viscose fibers and m-aramid fibers can be used in this case. This fabric is dyed or printed on the side visible when worn. Special attention must be paid that the actual protective package, consisting of fabrics coated with hard solids, can easily be removed, in order to permit uncomplicated cleaning, especially of the cover.

In the case of protective clothing intended to provide protection only against puncture injuries, a padding layer can be applied under the actual protective layers on the side adjacent to the body. This padding layer should consist of a compressible material. Suitable in this case are foamed plastics, felts, needle felts, superimposed layers of nonwoven fabrics, pile wovens, pile knits, etc. When a puncture implement such as a knife is applied, these padding layers produce a cushioning effect that can contribute to reduced penetration of the implement. Furthermore, it cushions somewhat the pressure acting on the body when a puncture implement is used.

For the manufacture of this padding layer, textile fabrics are preferred, and needle felts or nonwoven fabrics made from high-strength fibers are especially preferred. Aramid fibers are especially suited in this case. In addition to the aforementioned cushioning effect, they also offer added protection against punctures.

The fabrics coated with hard solids are preferably arranged in the protective clothing such that the hard-solid layer is on the side away from the wearer. In this way, the best puncture-protective action is obtained when using fabrics coated on one side. It is also possible, however, to arrange the coated side toward the inside, i.e., toward the wearer, or to select an alternating arrangement of fabrics coated with hard solids in the puncture-proofing package. Clothing that is to offer combined puncture and bullet protection is produced from more than one layer coated with hard solids, preferably from 2–20 layers, with 6–15 layers being especially preferred, and 6–50 layers of uncoated fabrics. The number of layers of uncoated fabrics in protective clothing for combined puncture and bullet protection is preferably 8–40, and 16–35 are especially preferred. Woven fabrics of aramid fibers are preferably used as the uncoated fabrics. The uncoated aramid fabrics, which form the actual bulletproof package, are arranged on the side facing the body. These fabrics are produced in the same manner as previously described for the aramid fabrics used as base materials for the hard-solid coating.

The protective package for combined puncture and bullet protection can be designed such that the actual puncture-proofing layers, which are those coated with hard solids, are joined to the uncoated aramid fabrics. For example, cut-to-shape pieces made from 6–50 layers of uncoated aramid fabrics are superimposed. 2–20 layers of fabrics coated on one side with hard solids are laid thereon such that the coated side is the outside. The individual layers of the package so formed are, for example, reinforced in the aforementioned manner with a crosswise double seam or by pointwise application of adhesive.

In the production of the protective clothing, the package is then, as previously described, sealed into a sheeting envelope and then in a woven-fabric cover, made for example of a fabric of polyester-cotton blended yarns. This insertion is performed such that the fabrics coated with hard solids are on the side facing away from the wearer and that a puncture implement or projectile first strikes the layers coated with hard solids.

The previously described construction of combined puncture and bulletproof clothing is understood to be the preferred embodiment. It is also possible to arrange the fabrics with hard solids in the packaging comprising a total of 8–70 layers such that they are not just on the outside of the protective clothing but rather, for example, distributed across the protective package, on the outside, in the middle, and on the inside. The arrangement of layers coated with hard solids is not limited to an embodiment in which the hard-solid layers are positioned away from the wearer toward the outside. The opposite arrangement, or an alternating arrangement, is possible, although the arrangement of the hard-solid layer toward the outside is preferred.

A particularly preferred embodiment of combined puncture and bulletproof clothing is provided by a variation that can optionally be used for protection against one of these threat types, i.e., protection against puncture injuries or against projectile injuries. It can be also be used simultaneously for protecting against both types of threats.

In this case, the actual bulletproof package is first formed from 6–50 layers of an aramid fabric not coated with hard solids, by superimposing suitable cut-to-shape pieces and reinforcing in the previously described manner. This package is sealed into a sheeting envelope.

In addition, a package is formed from 2–20 layers of a fabric coated with hard solids and also sealed into a sheeting envelope.

To accommodate both packages, a cover is made from a dyed or printed polyester-cotton woven fabric, for example. This fabric cover is then provided with a Velcro(R)-type fastening or zipper to enable simple insertion and removal of either or both of the packages.

If protective clothing is now to be offered for combined puncture and bullet protection, the two packages are, for example, inserted together into an envelope which then forms the outside layer of a bulletproof vest. The arrangement of the actual puncture-proof package, i.e., the package consisting of fabrics with hard-solid coating, is preferably accomplished by locating it on the side directed away from the wearer, i.e., the side initially subjected to an attack.

If puncture protection is not required, and only the threat of projectiles is anticipated, the actual puncture-proofing package made from fabrics coated with hard solids can be removed and the protective clothing used solely with a package of aramid woven fabrics to which no hard-solid coating has been applied.

An analogous approach is used if only the threat of puncture injuries is expected. In this case, the bulletproofing package consisting of uncoated aramid woven fabrics is removed from the clothing, and the protective package then consists solely of fabrics coated with hard solids. It is practical in this case to additionally insert a padding layer into the protective clothing where the bulletproof package formerly was. This padding layer, designed in the previously described manner, is also in an envelope, for example made from sheeting, so that simple insertion or removal of the padding layer is ensured.

The action of the hard-solid layer when encountering puncture implements has not yet been sufficiently explained. The observations noted in tests indicate that the hard solids present such high resistance to a puncture implement, such as a knife, that the implement is diverted somewhat laterally on encountering the first protective layer. The next resistance is produced by the base of the hard-solid layer, provided that it consists of suitable materials such as aramid fibers. This combined action of hard-solid layer and base causes the energy acting on the protective clothing by the puncture implement to be dissipated. Since the puncture implement must penetrate multiple layers, and this energy reduction occurs in each layer, the puncture energy in the lowermost layers is insufficient to allow the implement to penetrate and enter the body.

An additional effect is probably attributable to the fact that the acuity of a blade is reduced by the passage along the hard-solid particles. This reduces the opportunity for penetrating the layers underneath. Sharp-edged hard-solid particles appear to act in an especially favorable manner.

The protective action shows a dependence on the average grain diameter of the hard-solid particles. A diameter range of 10–500 $\mu$m has proven suitable. A range of 20–200 $\mu$m is preferred, and a range of 25–150 $\mu$m especially preferred.

In the abrasives industry, it is in part common to classify the hard solids with granulation indices. A granulation index of P 220 in accordance with FEPA corresponds in the case of fused alumina or silicon carbide, for example, to an average grain diameter of 66 $\mu$m. Of course, the grain diameters are subject to variation. In the average grain diameter of 66 $\mu$m cited as an example, the variation, normally subject to a normal distribution, can be expected to range from 40 to 90 $\mu$m.

It has been shown that for small average grain diameters under about 10 $\mu$m the desired protective action is no longer provided to the extent required, since small hard-solid particles have only slight action in the previously described manner. The cited limit of about 10 $\mu$m, however, does not apply generally. Depending on the overall thickness of the hard-solid layer, displacement to one side or the other can occur. Surprisingly, however, it was determined that relatively large average grain diameters exceeding 500 $\mu$m also do not provide better puncture protection compared to those in the mid-range. This can probably be explained by the fact that the coverage of the base material with hard solids is not as uniform for coarse particles as for finer particles, so that, overall, a larger surface portion of base material is produced that is inadequately coated with hard solids and allows a relatively high number of opportunities for the puncture implement to penetrate through the hard solids and the base material without significant obstruction.

The test of puncture-proof characteristics was conducted in accordance with the Research and Development Center for Police Technology in Munster, Germany. In this case, a puncture is made with a stiletto with double-edged pointed blade and weighing 2.6 kg. The test blade must act on the object under test with an energy of 35 J (corresponding to a fall height of 1.35 m). Prior to each puncture trial, a homogeneous film of lithium soap fat was applied to the test blade.

As the background material, a plastilina block is placed behind the test object. The penetration into this block or extent of bulging are the parameters for assessing the puncture-proof characteristics. According to the guidelines of the German police, a puncture-proof material exhibiting a penetration under 20 mm or a bulge under 40 mm is suitable for security force equipment.

In addition to the puncture test with a knife-like implement, tests were also carried out with a needle-like puncture implement. In this case, an ice pick, which is used in the U.S. standard for puncture testing, is employed. Determination is made whether the puncture implement is stopped or penetrates the sample.

To test the objects in the trial, the fall height and weight were varied, resulting in different puncture energy levels. In this case as well, the test is conducted by assessing the penetration. The fall heights and weights used in the trials correspond to the following puncture energy levels.

| Fall weight in g | Fall height in cm | Puncture energy in J |
|---|---|---|
| 7 027 | 1 | 0.7 |
| 7 027 | 50 | 35 |
| 2 403 | 10 | 2.3 |
| 2 403 | 90 | 21.2 |
| 2 403 | 100 | 23.6 |

The bombardment test was also conducted on the basis of the guidelines issued by the Research and Development Center for Police Technology, Münster.

The bombardment of the test object in this case takes place at a distance of 10 m, whereby the projectile speed is determined in each case. A plastilina block is positioned behind the object under test. From the depth of penetration into the plastilina, the so-called trauma effect is assessed.

As show in detail in the embodiment example, good protection against puncture implements can be attained with the protective clothing of the invention. This is true not only for puncture implements with cutting edges such as knives, daggers, but also for needle-like implements. In contrast to previously proposed protective clothing, the protective clothing of the invention offers, due to its relatively low weight, relatively low thickness, and its flexibility, the wearing comfort that security forces need in the line of duty when requiring a high degree of physical exertion.

This also applies when the puncture-proof layers are used in combination with bulletproof layers for combined protective clothing, i.e., for clothing that is to offer protection not only from puncture implements but also from projectiles.

EMBODIMENT EXAMPLE

For production of special puncture-proof layers, aramid woven fabrics coated with a hard-solid layer were employed. The fabric was produced from aramid filament yarns with a titer of 930 dtex. The same type of yarn was used in warp and weft. The thread count was 10.5 threads/cm in each case. In this manner, a woven fabric was obtained with a weight per unit area of 198 g/m$^2$.

This fabric was washed and, after intermediate drying, precoated with a modified polyacrylate. 45% calcium carbonate was added to the dispersion of the modified polyacrylate resin as a filler. The amount of precoating was selected such that the applied quantity in the wet state was 70 g/m$^2$. After drying, an applied quantity of 53 g/m$^2$ remained on the fabric. Drying was conducted at 100° C.

Subsequently, the application of the actual binder coating was conducted, for which a dispersion of a phenolic resin precursor and containing a filler was used. The amount of resin was 70%, the amount of filler (calcium carbonate) was 30%. The volume of binder layer was selected such that the binder amount in the wet state was 121 g/m$^2$ (dry weight 90 g/m$^2$). The fabric prepared in this manner was fed into a spreading zone in which silicon carbide particles with an average grain diameter of 66 $\mu$m, corresponding to a granulation index of P 220, were applied. Subsequently, a hardening of the binder film was conducted at a temperature of 130° C. Thereafter, the fabric coated with hard solids was subjected to a cross-flexing treatment.

The fabric produced thereby, coated with hard solids, was further processed into cut-to-shape pieces for protective vests. Of the cut pieces, three packages were constructed by superimposition, with a. 8 layers (total weight approx. 3 600 g/m$^2$)

b. 10 layers (total weight approx. 4 450 g/m$^2$), and c. 12 layers (total weight approx. 5 300 g/m$^2$)

The puncture-proof packages produced thereby were subjected to a puncture test with a stiletto in the manner previously described, with three individual tests being conducted. The following values were obtained for the depth of penetration into the plastilina layer:

a. 14 mm b. 6 mm c. 0 mm

In all cases, therefore, the specification, which required the penetration depth not to exceed 20 mm, was met.

To test the resistance against needle-like puncture implements, 10 layers of the fabrics, coated with hard solids in the prescribed manner, were superimposed. 28 layers of an untreated fabric were arranged under these coated layers. With a fall weight of 7 027 g, minimal penetration was noted only when the fall height of the puncture implement was 50 cm (puncture energy 35 J).

In contrast, the corresponding test was conducted with 28 layers of woven fabrics not coated with hard solids. In this case, a clear penetration was noted at a fall height of only 1 cm (puncture energy 0.7 J). Even an increase in the number of layers to 38 did not lead to sustained improvement. In this case as well, significant penetration was registered at a low puncture energy level of 0.7 J.

For a further puncture test with a needle-like puncture implement, the fall weight was reduced to 2 403 g. Again, 10 layers of the woven fabric coated with hard solids were formed into a package, under which 28 layers of an uncoated woven fabric were added, and subjected to a puncture test. At a fall height of 10 cm (puncture energy of 2.3 J), no penetration was noted. Increase of the fall height to 90 cm (puncture energy of 21.2 J) did not lead to penetration. Only when the fall height was 100 cm (puncture energy 23.6 J) did slight penetration occur.

In this case as well, a comparison was undertaken with a package of uncoated woven fabrics. In a package with 28 layers, there was significant penetration at a fall height of 10 cm (puncture energy of 2.3 J). Increasing the number of layers to 38 still resulted in penetration at this energy level.

These comparisons show the unexpectedly significant improvement in protective action attained with the protective clothing of the invention, not only from threats with knife-like implements but also primarily from those with needle-like puncture implements.

Since the protective clothing of the invention is to offer protection from not only puncture but also projectile injuries, a protective package was formed of 10 layers of an aramid woven fabric coated with hard solids in the manner described. This was placed in front of a package of 24 layers of an uncoated aramid woven fabric with a weight per unit area of approx. 200 g/m$^2$. In this manner, a protective package was formed for combined puncture and bullet protection. The arrangement was such that the actual puncture-proof layers, i.e., the aramid woven fabrics coated with hard solids, constituted the outside in the bombardment test. This means that in the bombardment test, the projectile first made contact with the layers coated with hard solids.

This package (package B) was subjected to a bombardment test in the manner previously described. In contrast, a package of 28 layers of an uncoated woven fabric (package A) was subjected to bombardment. The following results were obtained:

| Package structure | Bombardment vel., m/sec | Impact angle° | Penetration depth, mm | Complete penetration? |
|---|---|---|---|---|
| Package A | 415 | 90 | 31 | No |
| | 417 | 25 | 17 | No |
| Package B | 414 | 90 | 26 | No |
| | 415 | 25 | 15 | No |

The trials show that with a combined puncture and bulletproof package that contains puncture-proof layers of the type according to the invention, the bulletproof action is not reduced compared to a conventional bulletproof package.

What is claimed is:

1. Clothing for protection against puncture and/or projectile injuries, comprising:

a plurality of layers of fabric made from high-strength materials;

wherein more than one of the layers is coated with a hard-solid layer;

wherein the hard solid layer is comprised of hard solids embedded in a binder material selected from the group consisting of phenolic resins, urea resins, latex in cross-linked or non-cross-linked form, epoxy resins, and polyacrylate resins; and, wherein the fabrics coated with hard solids have been flexed after the coating process to break up the coated layer, resulting in the creation of islands of binder material including the hard solids anchored in the coated layer.

2. Protective clothing in accordance with claim 1, wherein the layers coated with the hard-solid layer are outer layers of the protective clothing.

3. Protective clothing in accordance with claim 1, wherein the protective clothing comprises 2–20 layers of fabric coated with the hard-solid layer.

4. Protective clothing in accordance with claim 1, wherein the protective clothing comprises 6–50 layers of an uncoated aramid woven fabric.

5. Protective clothing in accordance with claim 4, wherein the protective clothing comprises 2–20 layers of fabric coated with the hard-solid layer.

6. Protective clothing in accordance with claim 4, wherein the layers coated with the hard-solid layer are constructed as a removable package.

7. Protective clothing in accordance with claim 1, wherein protective layers of the protective clothing consist only of layers of fabric coated with the hard-solid layer.

8. Protective clothing in accordance with claim 7, wherein the protective clothing comprises a padding layer under the layers coated with hard-solid on a surface of the clothing facing a wearer.

9. Protective clothing in accordance with claim 1, wherein a base material of the layers coated with the hard-solid layer is a fabric made from a material selected from the group consisting of aramids, high-strength polyolefins, and other high-strength materials.

10. Protective clothing in accordance with claim 9, wherein the fabrics are woven fabrics made from a material selected from the group consisting of aramid yarns, yarns of polyethylene fibers spun using a gel spinning processes, and yarns of other high strength fibers.

11. Protective coating in accordance with claim 1, wherein the fabrics coated with the hard-solid layer have a thin layer of a polymer material on a hard-solid side.

12. Protective clothing in accordance with claim 1, wherein the hard-solid layer comprises at least one member selected from the group consisting of silicon carbide, high-quality fused alumina, standard corundum, secondary fused alumina, zirconium corundum, tungsten carbide, titanium carbide, molybdenum carbide, boron carbide, boron nitride, and mixtures thereof.

13. Protective clothing in accordance with claim 1, wherein the hard solids have an average grain diameter of 10–500 $\mu$m.

14. Protective clothing in accordance with claim 1, wherein the fabrics coated with hard solids have a thickness of 0.1–1.5 mm.

* * * * *

UNITED STATES PATENT AND TRADEMARK OFFICE

CERTIFICATE OF CORRECTION

PATENT NO. : 6,656,570 B1
DATED : December 2, 2003
INVENTOR(S) : Achim G. Fels et al.

It is certified that error appears in the above-identified patent and that said Letters Patent is hereby corrected as shown below:

Column 8,
Line 51, “Clothing” is the beginning of a new paragraph and should be indented;

Column 10,
Line 61, “Munster” should read either -- Münster -- or Muenster --;

Column 11,
Line 32, “Munster” should read either -- Münster -- or Muenster --;
Line 38, “show” should read -- shown --;
Line 42, add -- etc., -- after the word “daggers,”.

Signed and Sealed this

Fifth Day of October, 2004

JON W. DUDAS
*Director of the United States Patent and Trademark Office*